US010490132B2

(12) United States Patent
Park et al.

(10) Patent No.: US 10,490,132 B2
(45) Date of Patent: Nov. 26, 2019

(54) DISPLAY DEVICE AND DRIVING METHOD OF THE SAME

(71) Applicant: SAMSUNG DISPLAY CO., LTD., Yongin-si, Gyeonggi-do (KR)

(72) Inventors: Sung Un Park, Yongin-si (KR); Tae Wook Kim, Yongin-si (KR); Hyung Min Shin, Yongin-si (KR); Ju Bong An, Yongin-si (KR); Yeon Shil Jung, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 325 days.

(21) Appl. No.: 15/246,113

(22) Filed: Aug. 24, 2016

(65) Prior Publication Data

US 2017/0061885 A1 Mar. 2, 2017

(30) Foreign Application Priority Data

Aug. 28, 2015 (KR) ..... 10-2015-0121923

(51) Int. Cl.
*G09G 3/3266* (2016.01)
*G09G 3/3233* (2016.01)

(52) U.S. Cl.
CPC ..... *G09G 3/3266* (2013.01); *G09G 3/3233* (2013.01); *G09G 2300/0861* (2013.01); *G09G 2300/0866* (2013.01); *G09G 2310/08* (2013.01); *G09G 2320/0626* (2013.01); *G09G 2330/02* (2013.01); *G09G 2330/028* (2013.01)

(58) Field of Classification Search
None
See application file for complete search history.

(56) References Cited

U.S. PATENT DOCUMENTS 8,823,614 B2 9/2014 Lee
2007/0200814 A1* 8/2007 Kwon ..... G09G 3/2022 345/92
2008/0143704 A1* 6/2008 Choi ..... G09G 3/3233 345/212
2008/0284693 A1 11/2008 Sarma et al.
2008/0303982 A1* 12/2008 Jin ..... G02F 1/1335 349/69
2009/0108744 A1* 4/2009 Park ..... G09G 3/2011 313/504
2012/0032995 A1 2/2012 Lee
2012/0274624 A1* 11/2012 Lee ..... G09G 3/3648 345/213
2013/0321485 A1 12/2013 Eom et al.
2013/0335396 A1* 12/2013 Kim ..... G09G 3/3208 345/212

(Continued)

FOREIGN PATENT DOCUMENTS

KR 10-1258857 B1 5/2013
KR 10-2013-0136338 A 12/2013

*Primary Examiner* — Parul H Gupta
(74) *Attorney, Agent, or Firm* — Lewis Roca Rothgerber Christie LLP

(57) ABSTRACT

In an embodiment of the present invention, a display device includes a display unit including a plurality of pixels, a first power supply unit configured to supply a first power voltage to the display unit, and a second power supply unit configured to cyclically supply a second power voltage to the display unit during a frame period.

13 Claims, 13 Drawing Sheets

(56) References Cited

U.S. PATENT DOCUMENTS

2014/0063079 A1* 3/2014 Lee ..... G09G 5/02
345/690
2014/0253612 A1* 9/2014 Hwang ..... G09G 3/3258
345/691

* cited by examiner (a)

(b)

(a)

(b)

DISPLAY DEVICE AND DRIVING METHOD OF THE SAME

CROSS-REFERENCE TO RELATED APPLICATION

This application claims priority to, and the benefit of, Korean Patent Application No. 10-2015-0121923, filed on Aug. 28, 2015, in the Korean Intellectual Property Office, the entire content of which is incorporated herein by reference in its entirety.

BACKGROUND

1. Field

Embodiments of the present invention relate to a display device and a driving method of the same.

2. Description of the Related Art

Display devices are needed for the widely used devices of today, such as computer monitors, televisions, mobile phones, or the like. Display devices that display images using digital data include, for example, cathode-ray tube display devices, liquid crystal display (LCD) devices, plasma display panels (PDP), organic light emitting diode (OLED) display devices, or the like. The speeds of data transfer of these display devices are increasing as they become higher resolution and larger.

Meanwhile, one of the factors that contribute to improvement in display quality of an OLED display device may be gamma setting. Gamma setting is a correlation between display luminance and grayscale data, which may be defined by a gamma curve. Generally, display devices have a gamma characteristic such that the luminance of an image displayed does not increase linearly with an input signal level applied to a pixel. Here, gamma correction refers to adjustment due to the photoelectric conversion characteristics of the camera and the television being different and nonlinear (e.g., when light is converted into electric signals in a camera, and when a reverse process of converting the converted electrical signals back to image is performed in a television). A mathematical expression applicable here may be demonstrated as a curve, which is called a gamma curve.

Accurate gamma setting allows an OLED display device to maintain stable display quality. However, when there is an error in gamma setting, there may be difference between real display luminance and the luminance corresponding to grayscale data. To correct this difference, a reference gamma voltage, which is a voltage input into a driving circuit that generates data signals that determine display luminance, may be programmed in real time. In accordance with grayscale data, the driving circuit may use the reference gamma voltage to generate data signals, and light emitting diodes may emit light in accordance with the data signals. Therefore, when the reference gamma voltage is changed, the display luminance of the OLED display device is changed.

SUMMARY

Embodiments of the present invention relate to a display device capable of adjusting luminance of a display unit by controlling power supply, and a driving method thereof.

Embodiments of the present invention also relate to a method of lowering power consumption by power switching of a power supply unit, as opposed to by using a driving circuit and adjusting luminance.

Embodiments of the present invention further relate to a method of driving a display device capable of preventing grayscale inversion when adjusting luminance and 10-bit dimming or higher.

In an embodiment, a display device may include a display unit including a plurality of pixels, a first power supply unit configured to supply a first power voltage to the display unit, and a second power supply unit configured to cyclically supply a second power voltage to the display unit during a frame period.

The first power supply unit may include the second power supply unit.

The display device may further include a signal controller configured to transmit a control signal to the first power supply unit and to the second power supply unit.

The second power supply unit may be further configured to receive the first power voltage and an alternative second power voltage from the first power supply unit, generate and output a new second power voltage using the first power voltage and the alternative second power voltage, and cyclically supply the new second power voltage to the display unit during the frame period.

The display device may further include a second power voltage supply switch coupled between the display unit and the second power supply unit, and the second power supply unit may be configured to cyclically supply the second power voltage to the display unit depending on operation of the second power voltage supply switch.

The second power supply unit may be configured to determine a length of a section in which the second power voltage is supplied during the frame period depending on intended luminance of the display unit.

The second power supply unit may be configured to determine a size of the second power voltage supplied during the frame period depending on intended luminance of the display unit.

The second power supply unit may be configured to supply the second power voltage while changing the second power voltage during the frame period depending on intended luminance of the display unit.

The second power supply unit may be configured to supply the second power voltage while changing timing in which the second power voltage is supplied during the frame period depending on intended luminance of the display unit.

The first power supply unit may be further configured to continuously reduce the first power voltage during the frame period.

The first power supply unit may be further configured to change the first power voltage during the frame period, and may be further configured to supply the changed first power voltage to the display unit.

In an embodiment, a method of controlling a display device may include receiving a control signal at a second power supply unit, and cyclically supplying a second power voltage from the second power supply unit to a display unit during a frame period depending on the control signal.

The cyclically supplying the second power voltage further may include using the second power supply unit to determine a length of a section in which the second power voltage is supplied during the frame period depending on luminance of the display unit.

The cyclically supplying the second power voltage further may include using the second power supply unit to determine a size of the second power voltage supplied during the frame period depending on luminance of the display unit.

Cyclically supplying the second power voltage may further include supplying the second power voltage while using the second power supply unit to change a size of the second power voltage during the frame period depending on the luminance of the display unit.

The cyclically supplying the second power voltage may further include supplying the second power voltage while using the second power supply unit to change timing for which the second power voltage is supplied during the frame period depending on the luminance of the display unit.

According to an embodiment, there may be provided a display device for adjusting luminance of a display unit by controlling supply power, and a method of driving the same.

Embodiments of the present invention also relate to a way to lower power consumption, and to adjust luminance by power switching of a power supply unit, as opposed to by using a driving circuit.

Embodiments of the present invention further relate to a method of driving a display device capable of preventing grayscale inversion when adjusting luminance and 10-bit dimming or higher.

The aspects of the embodiments of the invention that may be obtained are not limited thereto, and other aspects that have not been mentioned will be clear to a person of ordinary skill in the art from the description provided hereafter.

BRIEF DESCRIPTION OF THE DRAWINGS

Example embodiments of the present invention will now be described more fully hereinafter with reference to the accompanying drawings, wherein.

DETAILED DESCRIPTION

Figure 1:
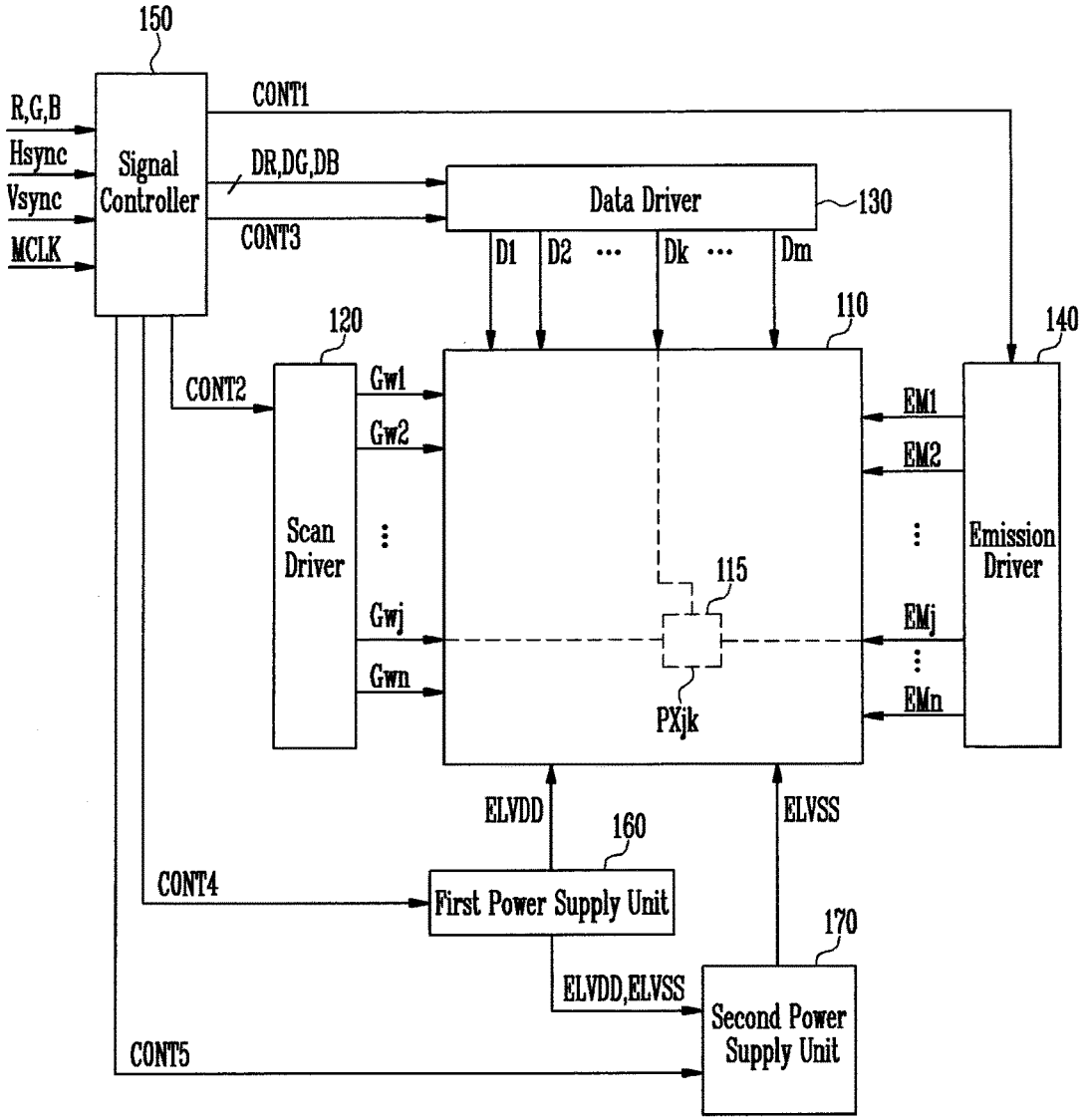
FIG. 1 illustrates a block diagram of a display device in accordance with an embodiment of the present invention.

Features of the inventive concept and methods of accomplishing the same may be understood more readily by reference to the following detailed description of embodiments and the accompanying drawings. The inventive concept may, however, be embodied in many different forms and should not be construed as being limited to the embodiments set forth herein. Hereinafter, example embodiments will be described in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof will not be repeated. In the drawings, the relative sizes of elements, layers, and regions may be exaggerated for clarity.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present invention. As used herein, the singular forms "a," "an," and "the" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

Figure 2:
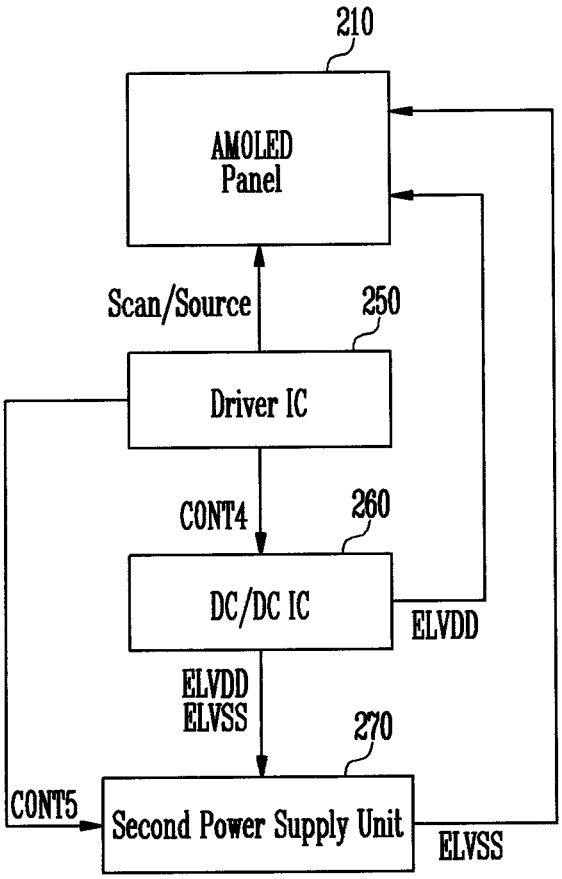
FIG. 2 illustrates another block diagram of a display device in accordance with an embodiment of the present invention.

FIG. 1 illustrates a block diagram of a display device in accordance with an embodiment of the present invention, and FIG. 2 illustrates another block diagram of a display device in accordance with an embodiment of the present invention.

Referring to FIG. 1, a display device in accordance with an embodiment of the present invention may include a display unit 110 that includes a plurality of pixels 115, a scan driver 120 that transfers a plurality of scan signals to the display unit 110, a data driver 130 that transfers a plurality of data signals to the display unit 110, an emission driver 140 that transfers a plurality of emission control signals to the display unit 110, a first power supply unit 160 and a second power supply unit 170 that supply a driving voltage to the display unit 110, and a signal controller 150 that supplies a plurality of control signals that control the scan driver 120, the data driver 130, the emission driver 140, the first power supply unit 160, and the second power supply unit 170.

The display unit 110 may be a panel on which the plurality of pixels 115 are arranged in a matrix, and each pixel 115 may include an OLED, which emits light corresponding to the flow of a driving current in accordance with data signals transferred from the data driver 130. Also, depending on the driving method, display devices may be classified into passive matrix OLED (PMOLED) and active matrix OLED (AMOLED). Here, in accordance with an embodiment of the present invention, the display device may be AMOLED.

In the display unit 110, a plurality of scan lines Gw1 to Gwn formed in a row direction that transfer scan signals from the scan driver 120, and a plurality of data lines D1 to Dm formed in a column direction that transfer data signals from the data driver 130, may be arranged. Also, in the display unit 110, a plurality of emission control lines EM1 to EMn formed in the row direction that transfer emission control signals from the emission driver 140 may be further arranged.

In other words, among the plurality of pixels 115, a pixel PXjk 115 located at a j-th pixel row and a k-th pixel column may be connected to a corresponding scan line Gwj, a corresponding data line Dk, and a corresponding emission control line EMj. However, this is only an example, and compositions and structures are not limited to what is described here. For example, the scan driver 120 and the emission driver 140 may be realized as a single driver.

The pixels 115 may include a pixel circuit that supplies a current to an OLED in accordance with corresponding data signals, and the OLED may emit light of certain luminance in accordance with the supplied current. Here, a first power voltage ELVDD for the operation of the display unit 110 may be supplied from the first power supply unit 160, and a second power voltage ELVSS may be supplied from the second power supply unit 170.

The scan driver 120 may apply a plurality of scan signals to the display unit 110 via the plurality of scan lines Gw1 to Gwn. The scan driver 120 may generate and transfer scan signals to scan lines respectively connected to lines of the plurality of pixels 115 included in the display unit 110 in accordance with scan driving control signals CONT2 supplied from the signal controller 150.

The data driver 130 may generate a plurality of data signals from image data signals DR, DG, and DB transferred from the signal controller 150, and may transfer the data signals to the plurality of data lines D1 to Dm coupled to the display unit 110. The operation of the data driver 130 may be performed according to data driving control signals CONT3 supplied by the signal controller 150.

The emission driver 140 may generate and transfer a plurality of emission control signals to respective ones of the plurality of emission control lines EM1 to EMn coupled to the display unit 110 in accordance with emission driver control signal CONT1 supplied from the signal controller 150.

In accordance with an embodiment of the present invention, the scan driver 120, the data driver 130, the emission driver 140, the signal controller 150, etc. may be realized, hardware-wise, as a single display driver IC.

The plurality of pixels 115 included in the display unit 110 may receive corresponding emission control signals, and accordingly, may display images by lighting the OLEDs with data voltages corresponding to the data signals.

Also, dimming of the emitted light (e.g., adjusting luminance) may be accomplished by using the emission driver 140 to repeatedly turn on and off each emission control line on a line-by-line basis. Dimming by the display driver IC by applying pre-saved gamma values may also be considered. However, when this method is used, grayscale luminance inversion may take place when dimming.

For example, in linear interpolation, when examining changes in register, it may be confirmed that register inversion takes place in grayscale other than V255, as shown in Table 1 below.

TABLE 1

| WRDISBV(51H) | | 225G | | 203G | | 151G | |
|---|---|---|---|---|---|---|---|
| | Luminance Level | Register | Voltage | Register | Voltage | Register | Voltage |
| Gamma set 7 | 255 | 241 | 4.53453 | 230 | 4.66369 | 224 | 4.80974 |
| Interpolation | 254 | 240 | 4.54186 | 230 | 4.67042 | 224 | 4.8158 |
| | 253 | 240 | 4.54186 | 230 | 4.67042 | 224 | 4.8158 |
| | . . . | . . . | . . . | . . . | . . . | . . . | . . . |
| | 217 | 225 | 4.65174 | 231 | 4.76678 | 224 | 4.90252 |
| | 216 | 225 | 4.65174 | 231 | 4.76678 | 224 | 4.90252 |
| Gamma set 6 | 215 | 225 | 4.65174 | 232 | 4.76218 | 225 | 4.89412 |
| Interpolation | 214 | 224 | 4.65907 | 232 | 4.76895 | 225 | 4.90024 |
| | . . . | . . . | . . . | . . . | . . . | . . . | . . . |

Also, gamma register resolution may be insufficient, such that the realization of 256-level dimming may be difficult.

Thus, a method of controlling the power of the power supply unit to adjust the luminance of an OLED may be used in a display device in accordance with an embodiment of the present invention. For this, the first power supply unit 160 may receive a first power supply unit control signal CONT4 from the signal controller 150, and, accordingly, may supply the first power voltage ELVDD to the display unit 110. The first power supply unit 160 may also transmit the first power voltage ELVDD and the second power voltage ELVSS to the second power supply unit 170.

The second power supply unit 170 may receive a second power supply unit control signal CONT5 from the signal controller 150, and, accordingly, may output the second power voltage ELVSS to the display unit 110. Here, the second power supply unit 170, in accordance with the second power supply unit control signal CONT5, may control the supply and blockage of the second power voltage ELVSS. Here, in accordance with an embodiment of the present invention, the second power voltage ELVSS may be generated by using the first power voltage ELVDD and the second power voltage ELVSS received from the first power supply unit 160, and by changing the second power voltage ELVSS received from the first power supply unit 160. For example, the second power supply unit 170 may either adjust the on/off duty of a switch depending on luminance by operating a switch connected to a supply line of the second power voltage ELVSS for one frame, or may change the size of the second power voltage ELVSS received from the first power supply unit 160 to output the second power voltage ELVSS to the display panel 110, allowing for natural luminance adjustment. Here, the second power supply unit control signal CONT5 may include control information for the second power supply unit 170 to supply and/or block the second power voltage ELVSS during one frame period.

In accordance with an embodiment of the present invention, the process of the second power supply unit 170 receiving the first power voltage ELVDD and the second power voltage ELVSS from the first power supply unit 160 may be omitted. In other words, the second power supply unit 170 may generate and output the second power voltage ELVSS in accordance with the control signal CONT5 received from the signal controller 150.

Referring to FIG. 2, a display driver (e.g., driver IC) 250 may transmit scan signals and source signals to a display panel (e.g., an AMOLED panel) 210. Here, in accordance with an embodiment of the present invention, the display panel 210 may be an AMOLED display panel, and the display driver 250 may include at least one among a scan driver, a data driver, an emission driver, and a signal controller. Here, the display driver 250 may transmit the power supply unit control signal CONT4 to a power supply unit (e.g., DC/DC IC) 260, and the power supply unit 260 may supply the first power voltage ELVDD to the display panel 210 in accordance with the received control signal CONT4. Here, the power supply unit 260 may be the first power supply unit. In a display device in accordance with an embodiment of the present invention, a second power supply unit 270 may receive the second power supply unit control signal CONT5 from the display driver 250, and may receive the first power voltage ELVDD and the second power voltage ELVSS from the first power supply unit 260. The second power supply unit 270, in accordance with the received second power supply unit control signal CONT5, may generate the first power voltage ELVDD received from the first power supply unit 160, and may generate and output a second power voltage ELVSS, and may control the supply and blockage of the second power voltage ELVSS to the display panel 210.

The term "first power supply unit" is used for ease of illustration, and therefore, may be any entity that serves to supply a first power voltage to a display unit, or anything that instructs a circuit to perform in such a manner. Also, the term "second power supply unit" is used for ease of illustration, and therefore, may be any entity that serves to supply a second power voltage to a display unit, or anything that instructs a circuit to perform in such a manner. For example, the "second power supply unit" may signify the power control method of a power supply unit, and is sometimes referred to as global illumination (GI) circuit. Here, the "first power supply unit" may simply be a power supply unit. In addition, the term "second power supply unit control signal" may be interchangeable with the term "GI control signal."

The detailed operations of the second power supply unit 170 and 270 are explained hereafter.

Figure 3:
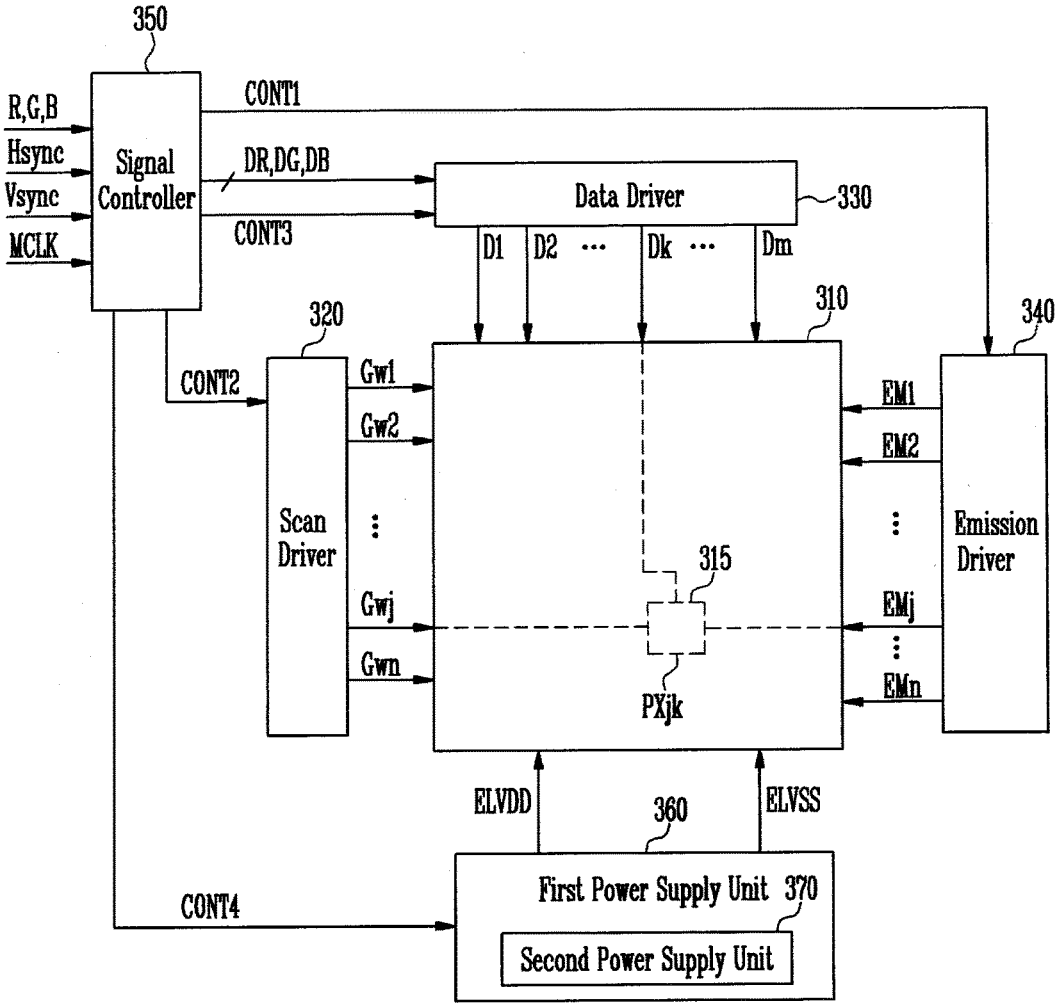
FIG. 3 illustrates a block diagram of a display device in accordance with another embodiment of the present invention.
Figure 4:
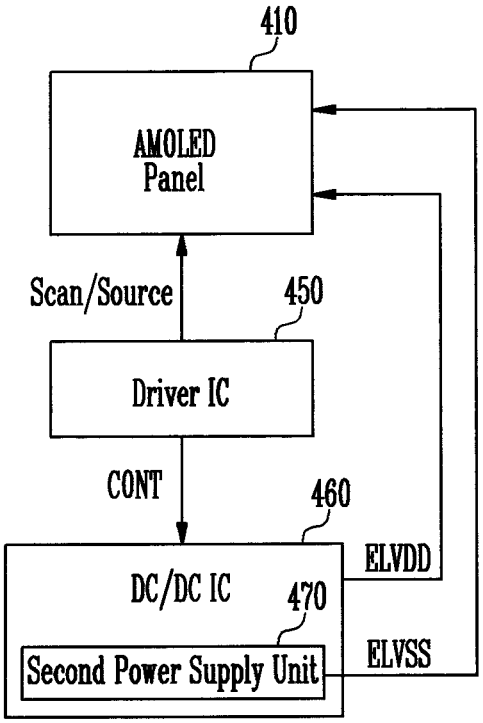
FIG. 4 illustrates another block diagram of a display device in accordance with another embodiment of the present invention.

FIG. 3 illustrates a block diagram of a display device in accordance with another embodiment of the present invention, and FIG. 4 illustrates another block diagram of a display device in accordance with another embodiment of the present invention.

Referring to FIG. 3, a display device in accordance with an embodiment of the present invention may include a display unit 310 that includes a plurality of pixels 315, a scan driver 320 that transfers a plurality of scan signals to the display unit 310, a data driver 330 that transfers a plurality of data signals to the display unit 310, an emission driver 340 that transfers a plurality of emission control signals to the display unit 310, a power supply unit (e.g., first power supply unit) 360 and a second power supply unit 370 that supply driving voltages to the display unit 310, and a signal controller 350 that supplies a plurality of control signals that control the scan driver 320, the data driver 330, and the emission driver 340, and the power supply unit 360.

The detailed operations of the display unit 310, the scan driver 320, the data driver 330, the emission driver 340, and the signal controller 350 are very similar to the respective operations of the display unit 110, the scan driver 120, the data driver 130, the emission driver 140, and the signal controller 150 of the display device of the embodiment of FIG. 1. Therefore, detailed explanation related thereto shall be omitted.

Here, the power supply unit 360 may include the second power supply unit 370, may receive the power supply unit control signal CONT4 from the signal controller 350, and accordingly, may supply the first power voltage ELVDD to the display unit 310. Here, the power supply unit 360 that supplies the first power voltage ELVDD shall be called a first power supply unit for ease of illustration.

The second power supply unit 370 included in the first power supply unit 360 may supply the second power voltage ELVSS to, and/or block the second power voltage ELVSS from, the display unit 310 in accordance with the power supply unit control signal CONT4 that the first power supply unit 360 has received from the signal controller 350. For example, the second power supply unit 370 may allow for natural luminance adjustment by adjusting the on/off duty of a switch by operating a switch connected to a supply line of the second power voltage ELVSS during one frame, and by changing the second power voltage ELVSS before outputting it. Here, the power supply unit control signal CONT4, in accordance with an embodiment of the present invention, may include a second power supply unit control signal. In other words, the power supply unit control signal CONT4 may additionally include a second power supply control signal, which includes control information for the second power supply unit 370 to supply and/or block the second voltage ELVSS during one frame period.

Although the second power supply unit 170 in FIG. 1 is an external circuit of the first power supply unit 160, in FIG. 3, the second power supply unit 370 is internalized within the first power supply unit 360.

Referring to FIG. 4, a display driver (e.g., driver IC) 450 may transmit scan signals and source signals to a display panel (e.g., AMOLED panel) 410. Here, in accordance with an embodiment of the present invention, the display panel 410 may be an AMOLED display panel, and the display driver 450 may include at least one among a scan driver, a data driver, an emission driver, and a signal controller. Here, the display driver 450 may transmit a power supply unit control signal CONT to a power supply unit (e.g., DC/DC IC) 460, and the power supply unit 460, depending on the received control signal CONT, may supply a first power voltage ELVDD to the display panel 410. Here, the power supply unit 460 may be a first power supply unit. In a display device of an embodiment of the present invention, the first power supply unit 460 may further include a second power supply unit 470, and the second power supply unit 470 may control supply and blockage of the second power voltage ELVSS to the display panel 410 in accordance with the control signal CONT that the first power supply unit 460 has received. Here, the power supply unit control signal CONT, in accordance with an embodiment of the present invention, may further include a second power supply unit control signal that includes control information for the second power supply unit 470 to supply and/or to block the second power voltage ELVSS during one frame period.

Detailed operations of the second power supply unit 370 will be described hereafter.

Figure 5:
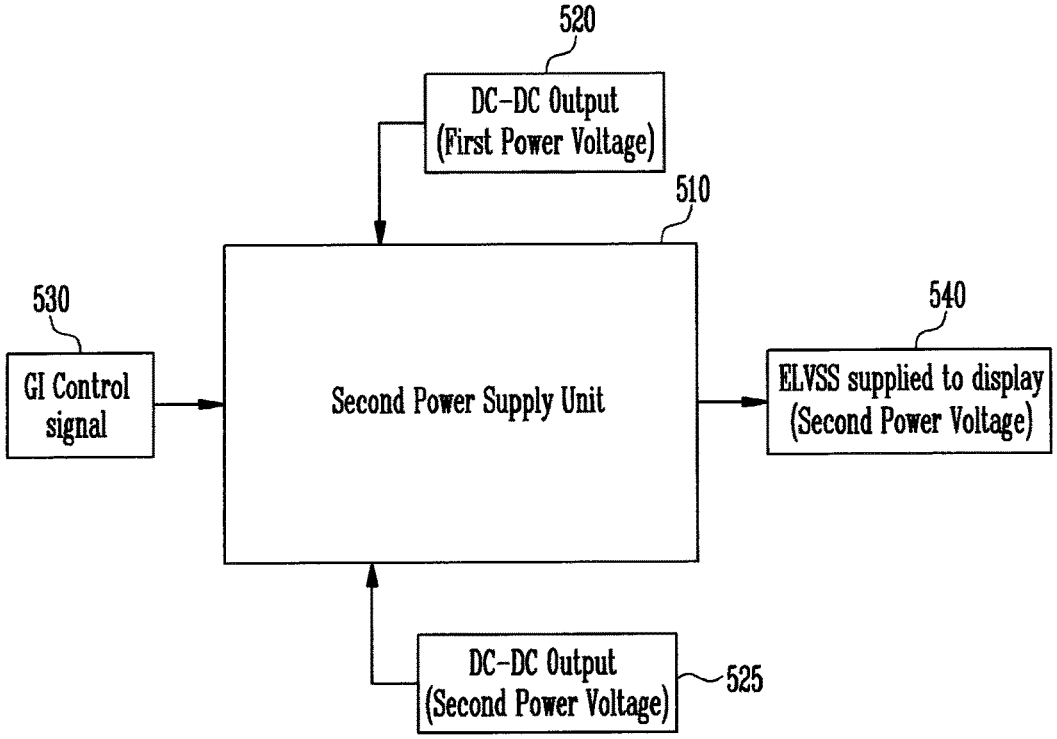
FIG. 5 illustrates a component block diagram of a second power supply unit in accordance with an embodiment of the present invention.
Figure 6:
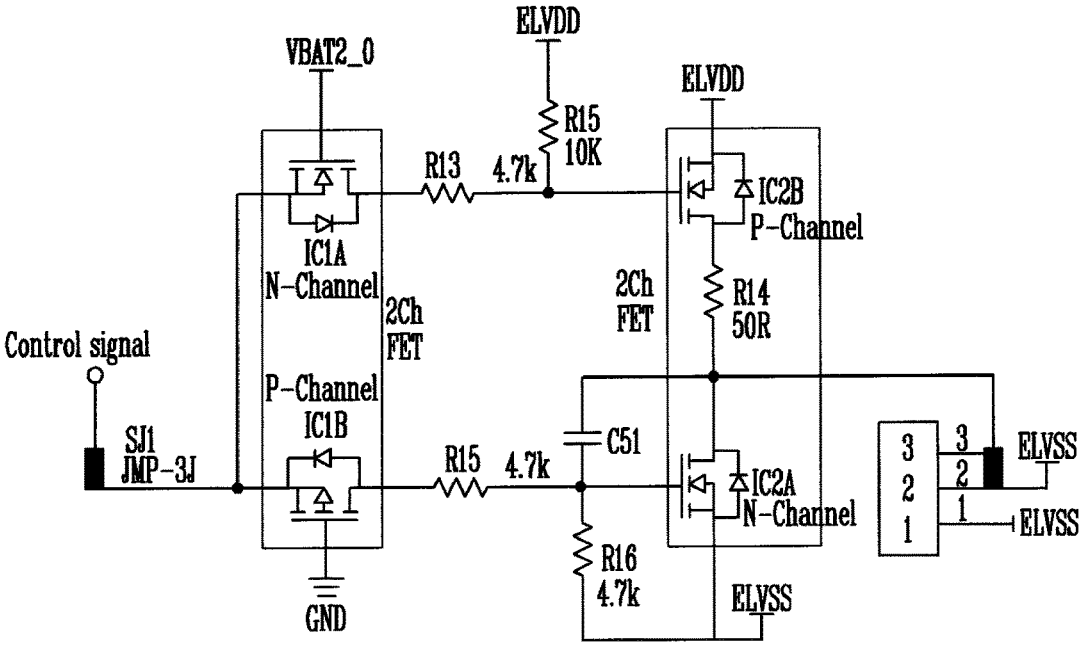
FIG. 6 illustrates a circuit diagram of a second power supply unit in accordance with an embodiment of the present invention.

FIG. 5 illustrates a component block diagram of a second power supply unit in accordance with an embodiment of the present invention, and FIG. 6 illustrates a circuit diagram of a second power supply unit in accordance with an embodiment of the present invention.

Referring to FIG. 5, a second power supply unit 510 may receive a second power supply unit control signal (GI Control signal) 530. The second power supply unit 510 may also receive a first power voltage (DC-DC Output) 520 and a second power voltage, which may be referred to as an alternative second power voltage (DC-DC Output) 525, from a first power supply unit. The second power supply unit 510, depending on the received control signal 530, may control the supply and blockage of a supplied second power voltage. Here, in accordance with an embodiment of the present invention, the second power supply unit 510 may generate and output a second power voltage, which may be referred to as a new second power voltage (ELVSS supplied to display) 540 to differentiate from the alternative second power voltage 525, using the first power voltage 520 and the second power voltage 525 received from the first power supply unit. In other words, the second power supply unit 510, in accordance with the second power supply unit control signal 530, may control the supply and blockage of the second power voltage 540 by using the first power voltage 520 and the second power voltage 525 that are received from the first power supply unit in accordance with the second power supply unit control signal 530.

In accordance with an embodiment of the present invention, the second power voltage (e.g., the new second power voltage) 540 may be generated by using the first power voltage 520, which is received from the first power supply unit, and by using the second power voltage (e.g., the alternative second power voltage) 525. For example, the second power voltage 540 may be a voltage changed in size from the second power voltage 525 received from the first power supply unit. For example, the second power supply unit 510 may adjust the on/off duty of a switch according to an intended luminance by turning on/off a switch coupled to a supply line of the second power voltage 540 during one frame. The second power supply unit 510 may also change the size of the second power voltage 525 received from the first power supply unit, and may output it as a second power voltage 540, allowing for natural luminance adjustment. Here, when the second power supply unit 510 is included in the first power supply unit, the second power supply unit control signal 530 may be included in the control signal that is transmitted to the first power supply unit, and transmitted with that control signal. In accordance with an embodiment of the present invention, the operation in which the second power supply unit 510 receives the first power voltage 520 and the second power voltage 525 from the first power supply unit may be omitted, and the second power voltage 540 may be generated based on the received control signal 530.

Referring to FIG. 6, the second power supply unit may include two 2-channel switches. In the present embodiment, the two 2-channel switches may be field effect transistors (FET). The first power voltage ELVDD and the second power voltage ELVSS may be received through a second FET. Through a first FET, a second power supply unit control signal may be received, and the second power voltage may be output accordingly. The circuit diagram of the second power supply unit, shown in the figure, and the values for the included resistances, transistors, etc. are presented as examples, and the present invention is not limited to these examples.

Figure 7:
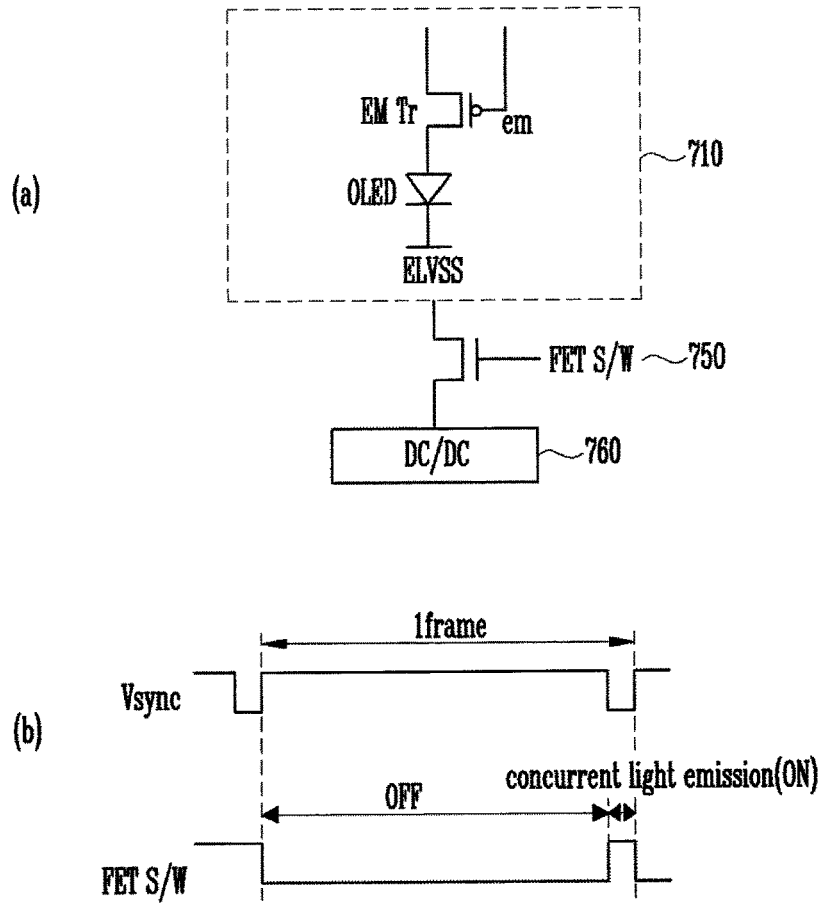
FIG. 7 illustrates the power supply workings of a second power supply unit in accordance with an embodiment of the present invention in low resolution.
Figure 8:
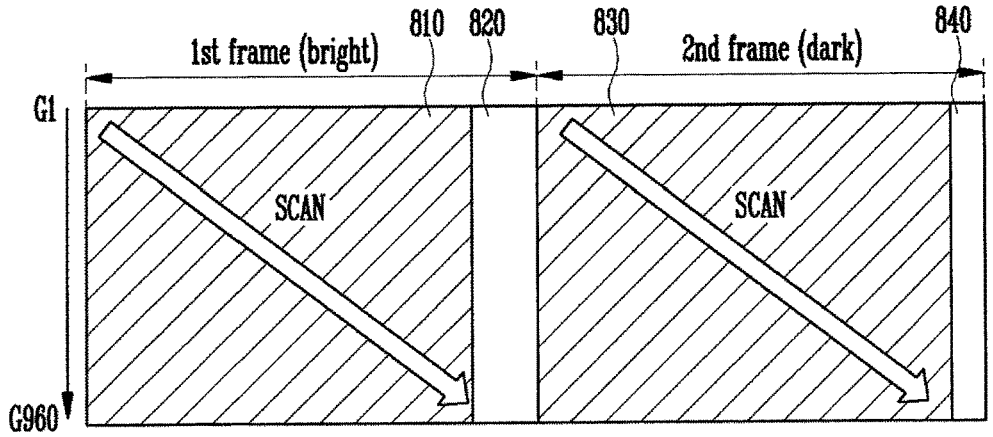
FIG. 8 illustrates the supply of power of a second power supply unit in accordance with an embodiment of the present invention in low resolution.

FIG. 7 illustrates the second power supply operation of a second power supply unit in accordance with an embodiment of the present invention in low resolution, and FIG. 8 illustrates the second power supply of a second power supply unit in accordance with an embodiment of the present invention in low resolution.

Referring to portion (a) of FIG. 7, a display panel 710 may include an emission control transistor EM Tr, which receives an emission control signal em, and an OLED. A second power supply unit (DC/DC) 760 may also supply a second power voltage ELVSS to a display panel 710. Here, the second power supply unit 760 may be a component responsible for supplying a second power voltage, and may be included in a power supply unit (e.g., a general power supply unit). A switch (FET S/W) 750 may be included between the second power supply unit 760 and the display panel 710. The second power supply unit 760 may adjust the on/off duty of the switch 750 according to a desired luminance by turning on/off the switch 750 connected to a supply line of the second power voltage ELVSS during one frame. Also, in accordance with an embodiment of the present invention, by changing and then outputting the second power voltage ELVSS, the second power supply unit 760 may be rendered capable of naturally adjusting luminance. Here, in accordance with an embodiment of the present invention, the switch 750 may be a FET switch. In addition, the second power supply unit 760 and the FET switch 750 are illustrated as separate components in the present embodiment, but the second power supply unit 760 and the FET switch 750 may be integrated to make one entity of a power supply unit in other embodiments of the present invention.

Here, as shown in part (b) of FIG. 7, in one frame of the display device, the FET switch (FET S/W) 750 may be turned on for the same amount of time in which a vertical synchronization signal Vsync is input, thereby enabling the second power voltage ELVSS to be supplied. When the vertical synchronization signal Vsync is not input (e.g., a "Vblank section," or "OFF section"), the FET switch 750 may be turned off, thereby preventing the second power voltage from being supplied. Accordingly, dimming in low resolution may be performed by blocking the supply of the second power voltage ELVSS in the OFF section.

In accordance with an embodiment of the present invention, there may be a higher possibility of adjusting light emission time in low resolution when LTPS (Low Temperature Poly Silicon) timing is not linked. Also, synchronization of the supply/blockage operation of the second power voltage enables the display to work.

In FIG. 8, it is assumed that, in low resolution, a first frame is to display a bright screen, and a second frame is to display a darker screen. Here, in the non-light-emitted region 810 of the first frame, the supply of the second power voltage ELVSS may also be blocked. In the light-emitted region 820, the second power voltage ELVSS may be supplied in addition to the light emission. Here, the screen of the first frame is bright in comparison to the screen of the second frame, so, for example, light emission time 820 may account for 10% of the first frame, while non-light emission time 810 may account for 90% of the first frame. In addition, during the non-light-emitted region 830 of the second frame, the supply of the second power voltage ELVSS may also be blocked. During the light-emitted-region 840, the second power voltage ELVSS may be supplied during the light emission. Here, the second frame is a relatively dark screen, so, for example, light emission time 840 may account for 5% of the time of the second frame, while non-light emission time 830 may account for 95% of the time in the second frame. Thus, when high luminance is to be displayed, the supply time of the second power voltage ELVSS may be increased, and when low luminance is to be displayed, the supply time of the second power voltage ELVSS may be decreased.

Figure 9:
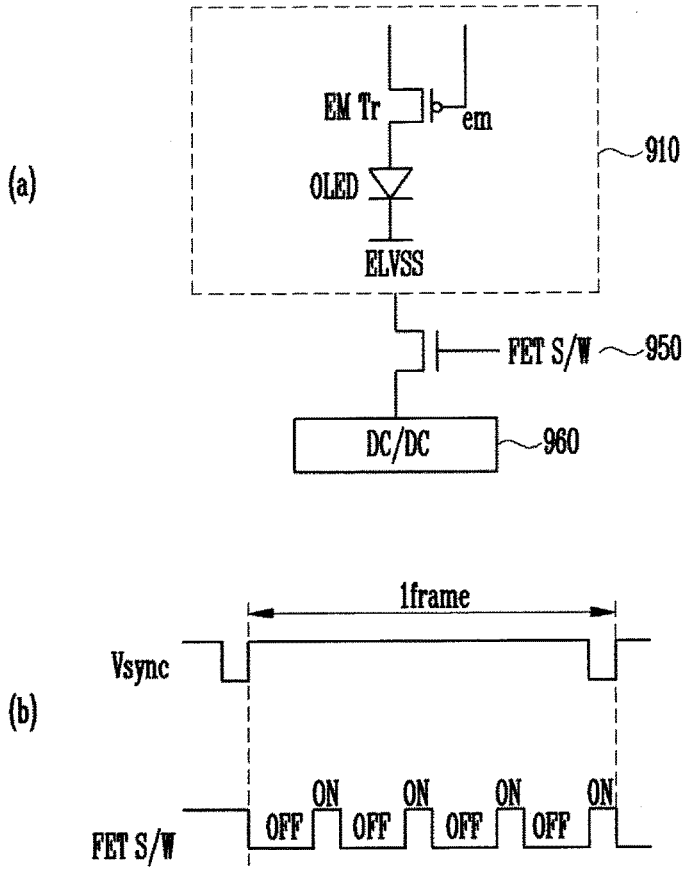
FIG. 9 illustrates the power supply workings of a second power supply unit in accordance with an embodiment of the present invention in high resolution.
Figure 10:
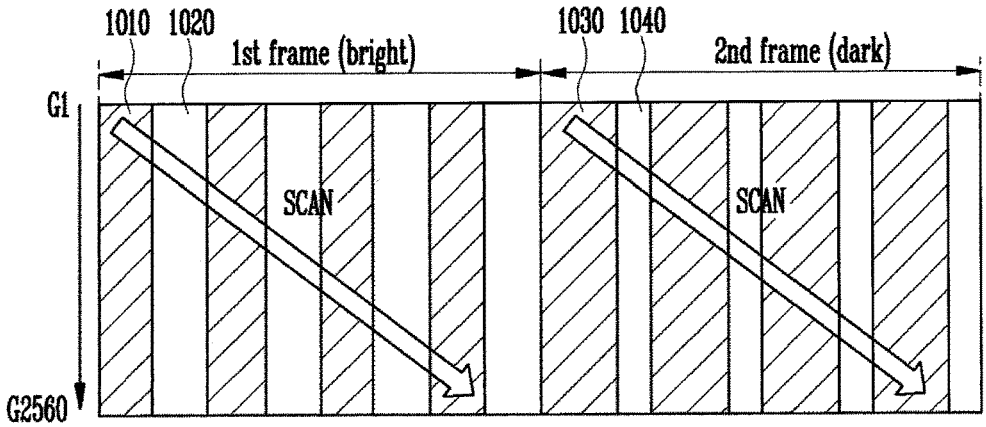
FIG. 10 illustrates the supply of power of a second power supply unit in accordance with an embodiment of the present invention in high resolution.

FIG. 9 illustrates the second power supply operation of a second power supply unit in accordance with an embodiment of the present invention in high resolution, and FIG. 10 illustrates the second power supply of a second power supply unit in accordance with an embodiment of the present invention in high resolution.

Referring to part (a) of FIG. 9, a display panel 910 may include an emission control transistor EM Tr, which is configured to receive an emission control signal em, and an OLED. A second power supply unit (DC/DC) 960 may supply the second power voltage ELVSS to the display panel 910. Here, the second power supply unit 960 may be a component that supplies a power voltage, and may be included in a power supply unit (e.g., a general power supply unit). A switch (FET S/W) 950 may also be included between the second power supply unit 960 and the display panel 910. During one frame, the second power supply unit 960 may turn on/off the switch 950 connected to a supply line of the second power voltage ELVSS, and may adjust the on/off duty of the switch 950 depending on an intended luminance. Also, in accordance with an embodiment of the present invention, the second power supply unit 960 may be rendered capable of naturally adjusting luminance by changing the second power voltage, and then outputting it. Here, in accordance with an embodiment of the present invention, the switch 950 may be a FET switch. Also, the second power supply unit 960 and the FET switch 950 are described as separate components in the present embodiment, but the second power supply unit 960 and the FET switch 950 may be integrated to be part of a power supply unit in other embodiments.

Here, as shown in part (b) of FIG. 9, in high resolution, the FET switch 950 may be turned on and off cyclically and repeatedly in the entire course of one frame. In other words, the second power voltage ELVSS may be supplied and blocked cyclically and repeatedly in the entire course of one frame. Here, dimming capabilities may be increased or maximized because the supply and blockage of the second power voltage ELVSS are driven separately from scan signals. Meanwhile, in accordance with an embodiment of the present invention, the length of each section in which the second power voltage ELVSS is supplied may be the same as that of a section in which a vertical synchronization signal Vsync is input, depending on the luminance of the displayed data.

Synchronization of the supply/blockage operation of the second power voltage ELVSS enables the display to work.

In FIG. 10, it is assumed that a first frame is to display a bright screen, and a second frame is to display a relatively darker screen. Here, regions in which the supply of the second power voltage is blocked 1010, and regions in which the second power voltage is supplied 1020, may alternate cyclically. Further, in second frame regions in which the supply of the second power voltage ELVSS is blocked 1030, and second frame regions in which the second power voltage ELVSS is supplied 1040, may alternate cyclically. Here, the first frame may correspond to a relatively bright screen when compared to the second frame, and the length of the section in which the second power voltage ELVSS is supplied 1020 in the first frame may be longer than that of the section in which the second power voltage ELVSS is supplied 1040 in the second frame. Thus, when high luminance is intended to be displayed, the supply time of the second power voltage ELVSS may be increased, and when low luminance is intended to be displayed, the supply time of the second power voltage ELVSS may be decreased to perform dimming.

Figure 11:
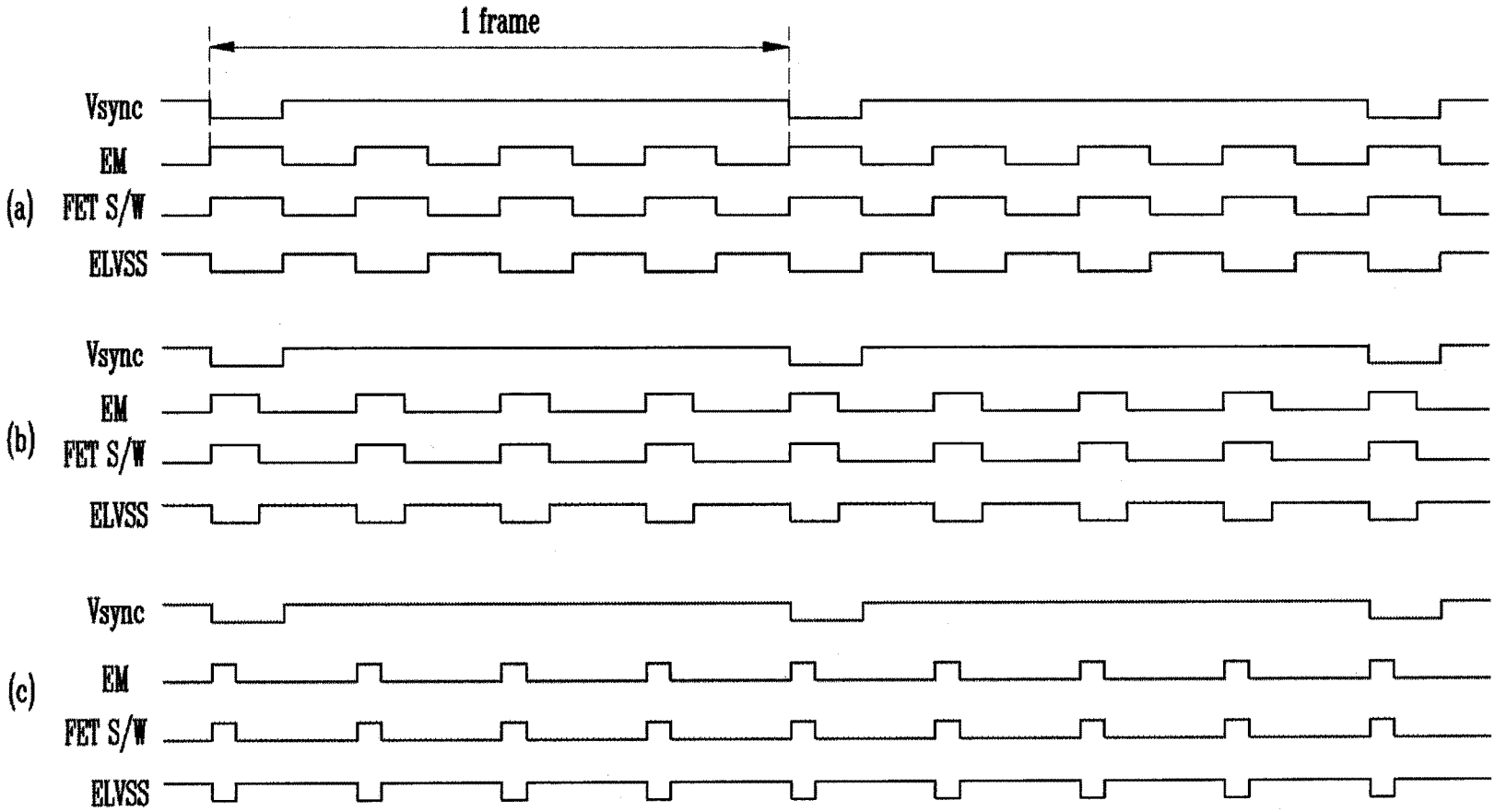
FIG. 11 illustrates a timing chart of the supply of a second power voltage in accordance with an embodiment of the present invention.

FIG. 11 illustrates a supply timing chart of a second power voltage in accordance with an embodiment of the present invention.

Referring to FIG. 11, the second power voltage ELVSS may be repeatedly and cyclically supplied and blocked throughout the entire course of one frame.

Part (a) of FIG. 11 is a timing chart for when high luminance is displayed. Referring to part (a) of FIG. 11, to supply the second power voltage ELVSS, the second power voltage supply switch FET SM may be turned on/off cyclically throughout the entire course of one frame. When the second power voltage supply switch FET SAN is turned on, the second power voltage ELVSS may be supplied to the display unit, and when the second power voltage supply switch FET SM is turned off, the supply of the second power voltage ELVSS to the display unit may be blocked. In accordance with an embodiment of the present invention, to eliminate effects on pixel circuits due to level changes in the second power voltage, an emission control transistor EM Tr may be used. In other words, the emission control signal may be supplied during the section to which the second power voltage ELVSS is supplied (i.e., the section where the second power voltage supply switch FET S/W is turned on), thereby reducing or eliminating unwanted effects on pixel circuits due to level changes in the second power voltage ELVSS. Also, in accordance with an embodiment of the present invention, when high luminance is displayed, the length of each section in which the second power voltage ELVSS is supplied during one frame may be the same as that of a section in which a vertical synchronization signal Vsync is input.

Part (b) of FIG. 11 is a timing chart for when medium-level luminance is displayed. Referring to part (b) of FIG. 11, the second power voltage supply switch FET S/W, which is used to supply the second power voltage ELVSS, may be turned on/off cyclically throughout the entire course of one frame. When the second power voltage supply switch FET SAN is turned on, the second power voltage ELVSS may be supplied to the display unit, and when the second power voltage supply switch FET S/W is turned off, the supply of the second power voltage ELVSS to the display unit may be blocked. Here, the length of a section in which the second power voltage ELVSS is supplied may be shorter than a corresponding section when high luminance is displayed. In other words, the length of a section in which the second power voltage ELVSS is supplied may correspond to a luminance that is intended to be displayed. For example, the luminance to be displayed and the length of a section in which the second power voltage ELVSS is supplied may be proportional to each other.

Part (c) of FIG. 11 is a timing chart for when low luminance is displayed. Referring to part (c) of FIG. 11, to supply the second power voltage ELVSS, the second power voltage supply switch FET S/W may be turned on/off cyclically throughout the entire course of one frame. When the second power voltage supply switch FET SAN is turned on, the second power voltage ELVSS may be supplied to the display unit, and when the second power voltage supply switch FET SAN is turned off, the supply of the second power voltage ELVSS to the display unit may be blocked. Here, the length of a section in which the second power voltage ELVSS is supplied may be shorter than corresponding sections when high or medium luminance is displayed.

Thus, the higher that the luminance displayed is, the longer the length of each section in which the second power voltage ELVSS is supplied in one frame. Similarly, the lower the luminance may be, the shorter the length of each section in which the second power voltage ELVSS is supplied in one frame may be.

In the drawings, the length of each section in which the second power voltage ELVSS is supplied in one frame is illustrated to be the same, although the present invention is not limited thereto. In other words, in the course of one frame period, the length of a section in which the second power voltage is supplied in one frame may vary. For example, in the case of medium luminance, the lengths of sections in which the second power voltage ELVSS is supplied in one frame may be different from one another. That is, assuming that in one frame, the second power voltage is supplied four times, and assuming that the length of the first supply section is 1 (e.g., 1 being an arbitrary unit of time), the length of the second supply section may then be 0.5, the length of the third supply section may be 1, and the length of the fourth supply section may be 0.5. Or if the length of the first supply section is assumed to be 1, the length of the second supply section may be 0.75, the length of the third supply section may be 0.25, and the length of the fourth supply section may be 1.

Figure 12:
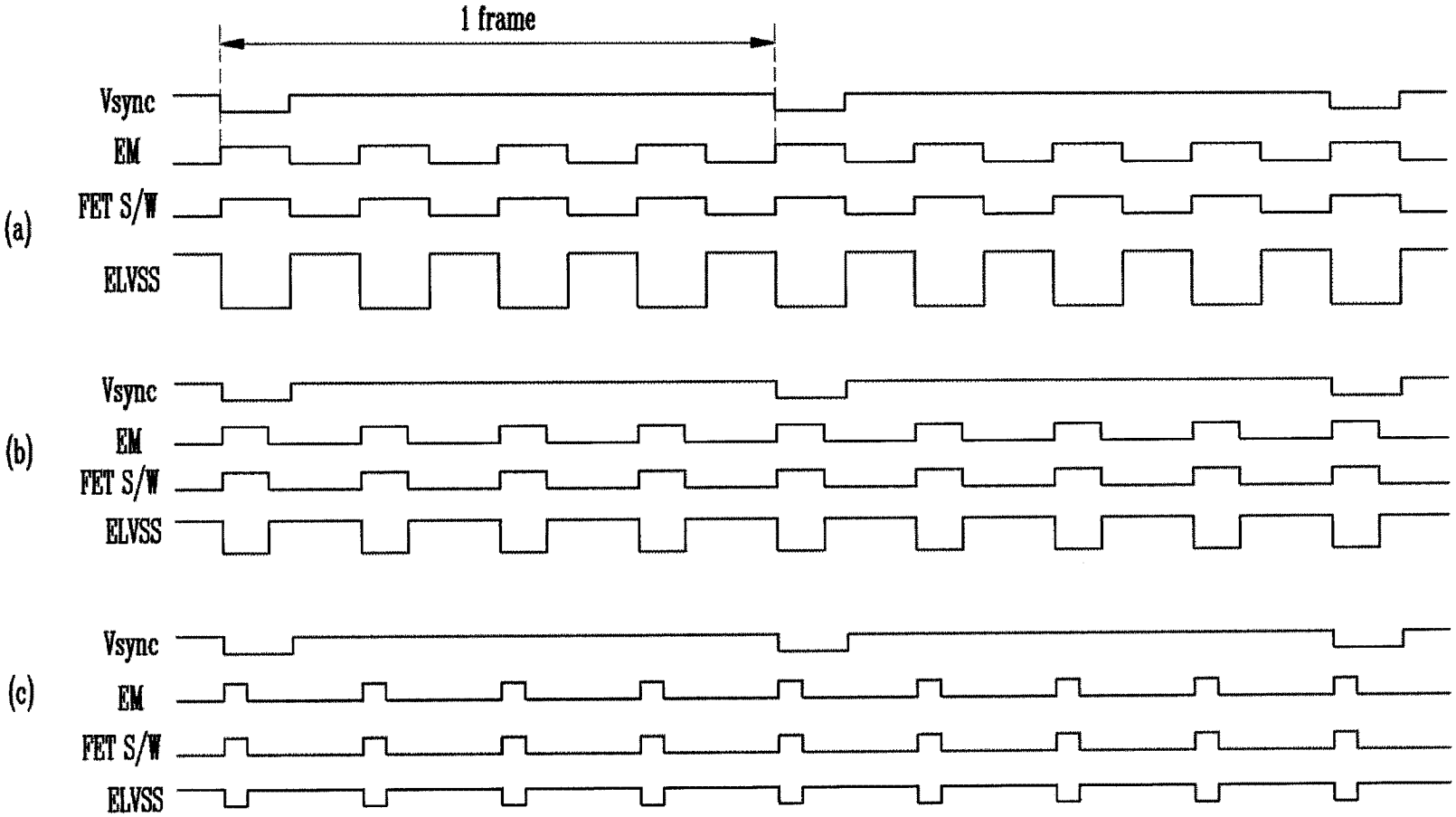
FIG. 12 illustrates a timing chart of the supply of a second power voltage in accordance with another embodiment of the present invention.

FIG. 12 illustrates a supply timing chart of a second power voltage in accordance with another embodiment of the present invention.

Referring to FIG. 12, to supply the second power voltage ELVSS, the second power voltage supply switch FET S/W may be turned on/off cyclically and repeatedly throughout the entire course of one frame. When the second power voltage supply switch FET S/W is turned on, the second power voltage ELVSS may be supplied to the display unit, and when the second power voltage supply switch FET S/W is turned off, the supply of the second power voltage ELVSS to the display unit may be blocked. In accordance with an embodiment of the present invention, to eliminate effects on pixel circuits due to level changes in the second power voltage, an emission control transistor EM Tr may be used. In other words, an emission control signal may be supplied to a section in which the second power voltage ELVSS is supplied, that is, a section in which the second power voltage supply switch FET S/W is turned on, and may thereby reduce or eliminate unwanted effects on pixel circuits due to level changes in the second power voltage. Also, in accordance with an embodiment of the present invention, when high luminance is displayed, the length of each section in which the second power voltage ELVSS is supplied in one frame may be the same as that of a section in which a vertical synchronization signal Vsync is input.

Here, the level of the second power voltage ELVSS may vary depending on the displayed luminance. For example, when the displayed luminance is high, the level of the second power voltage ELVSS may be high, and when the luminance of data is low, the level of the second power voltage ELVSS may be low.

For example, when luminance is high, as shown in part (a) of FIG. 12, the level of voltage may be high, so the second power voltage ELVSS may be, for example, about −4.0V. And when luminance is medium, as shown in part (b) of FIG. 12, the level of voltage may be lower than when luminance is high, so the second power voltage ELVSS may be, for example, about −3.0V. Also, when luminance is low, as shown in part (c) of FIG. 12, the level of voltage may be lower than when luminance is high or medium, so the second power voltage ELVSS may be, for example, about −2.0V. Thus the power consumption of the display device may be lowered by changing the second power voltage ELVSS in accordance with the displayed luminance and supplying it to the display unit.

Figure 13:
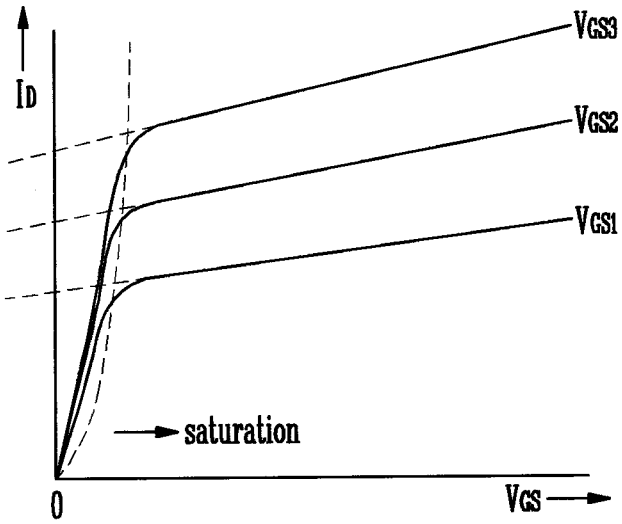
FIG. 13 illustrates measurements on changes in luminance when a second power voltage is being changed by channel length modulation.
Figure 13:
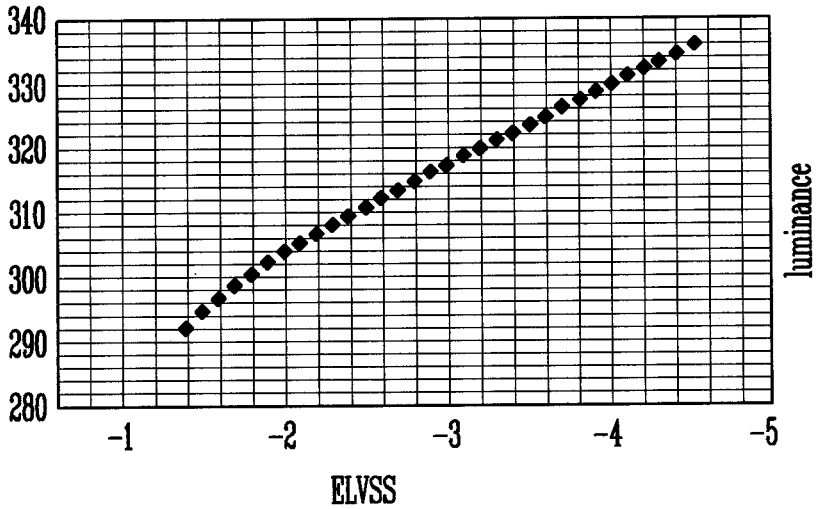
Figure 14:
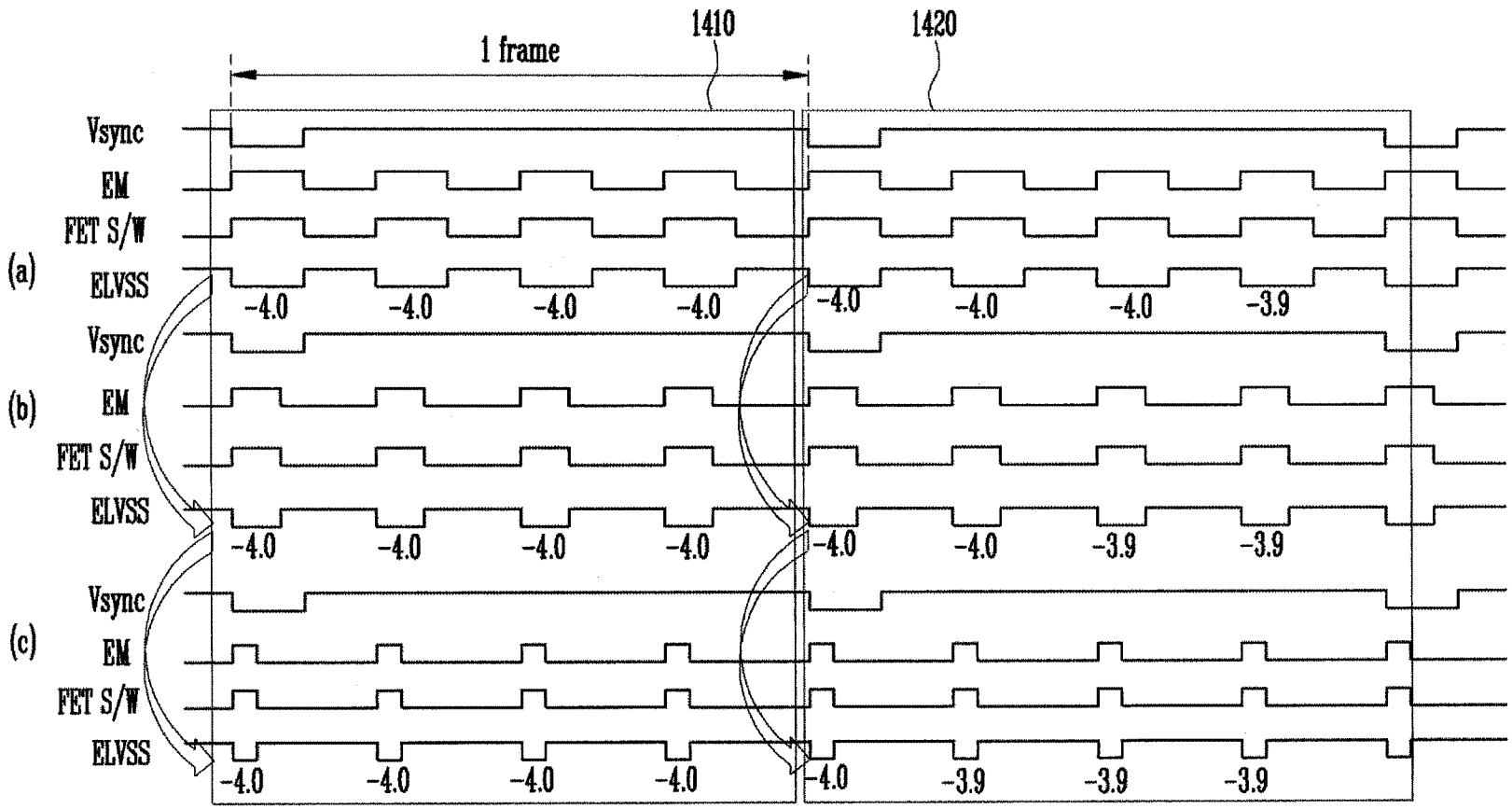
FIG. 14 illustrates a timing chart of the supply of a second power voltage in accordance with another embodiment of the present invention.

FIG. 13 illustrates measurements on changes in luminance when a second power voltage is changed by channel length modulation, and FIG. 14 illustrates a timing chart of the supply of a second power voltage in accordance with another embodiment of the present invention.

Part (a) of FIG. 13 shows channel length modulation, and part (b) of FIG. 13 illustrates the results of measurements on changes in luminance per second power voltage ELVSS. As shown in FIG. 13, when the second power voltage is changed, subtle changes may occur in the luminance of the display unit, that is, of the OLED.

When the second power voltage is supplied/blocked cyclically throughout the entire course of one frame, the second power supply unit may supply the second power voltage, changing it. For example, when the second power voltage is supplied four times in one frame period, each time may be referred to as one of a first duty to a fourth duty. Here, the second power supply unit may apply a different voltage as the second power voltage ELVSS to each duty to improve subtle luminance adjustment, that is, to improve dimming levels, and to increase resolution.

Referring to Table 2 below, when there are 4 duties, the second power supply unit may supply the second power voltage in one frame period, thereby changing it.

TABLE 2

| | 1st duty | 2nd duty | 3rd duty | 4th duty |
|---|---|---|---|---|
| 255 level | −4.0 | −4.0 | −4.0 | −4.0 |
| 254 level | −4.0 | −4.0 | −4.0 | −3.9 |
| 253 level | −4.0 | −4.0 | −3.9 | −3.9 |
| 252 level | −4.0 | −3.9 | −3.9 | −3.9 |
| 251 level | −3.9 | −3.9 | −3.9 | −3.9 |
| 250 level | −3.9 | −3.9 | −3.9 | −3.8 |
| 249 level | −3.9 | −3.9 | −3.8 | −3.8 |
| 248 level | −3.9 | −3.8 | −3.8 | −3.8 |
| 247 level | −3.8 | −3.8 | −3.8 | −3.8 |
| . . . | . . . | . . . | . . . | . . . |

For example, the second power supply unit may supply the same second power voltage ELVSS of about −4.0V in one frame period to mark 255 level. However, to mark 254 level, the second power supply unit may supply the second power voltage ELVSS of −3.9V at one of the four duties in one frame period. To mark 253 level, the second power supply unit may supply the second power voltage of about −3.9V at two of the four duties in one frame period, and the second power voltage of about −4.0V at the other two of the four duties in one frame period.

Referring to FIG. 14, in the first frame 1410, as explained with reference to FIG. 11, the second power supply unit may supply the second power voltage ELVSS cyclically throughout the entire course of one frame. The length of a section in which the second power voltage ELVSS is supplied may be determined by a luminance intended to be displayed. In other words, in one frame, the second power voltage ELVSS may be invariable, and the same voltage may be supplied.

However, in the second frame 1420, the second power voltage ELVSS, cyclically supplied in one frame, may be variable. For example, in high luminance, as shown in part (a) of FIG. 14, a second power voltage ELVSS, which may be lower than those supplied during the first duty to the third duty, may be supplied during the fourth duty. In other words, during the first duty to the third duty, a second power voltage of −4.0V may be supplied, and during the fourth duty, a second power voltage of about −3.9V may be applied. Here, in accordance with an embodiment of the present invention, it may be possible that, during any one of the first duty to the third duty, about −3.9V is supplied, and that, during the remaining three duties, about −4.0V is supplied.

And in the case of medium luminance, as shown in part (b) of FIG. 14, a second power voltage of about −3.9V may be supplied during two duties among the four duties supplied during the second frame 1420, and a second power voltage of about −4.0V may be supplied during the other two duties. And in the case of low luminance, as shown in part (c) of FIG. 14, a second power voltage of about −3.9V may be supplied during three duties among the four duties supplied during the second frame 1420, and a second power voltage of about −4.0V may be supplied during the remaining one duty of the four duties.

In other words, a second power supply unit in accordance with an embodiment of the present invention may supply the second power voltage cyclically to the display unit during one frame period. Here, the length of each section in which the second power voltage is supplied may be different depending on luminance, and also, the level of the second power voltage supplied to each section may be different.

Figure 15:
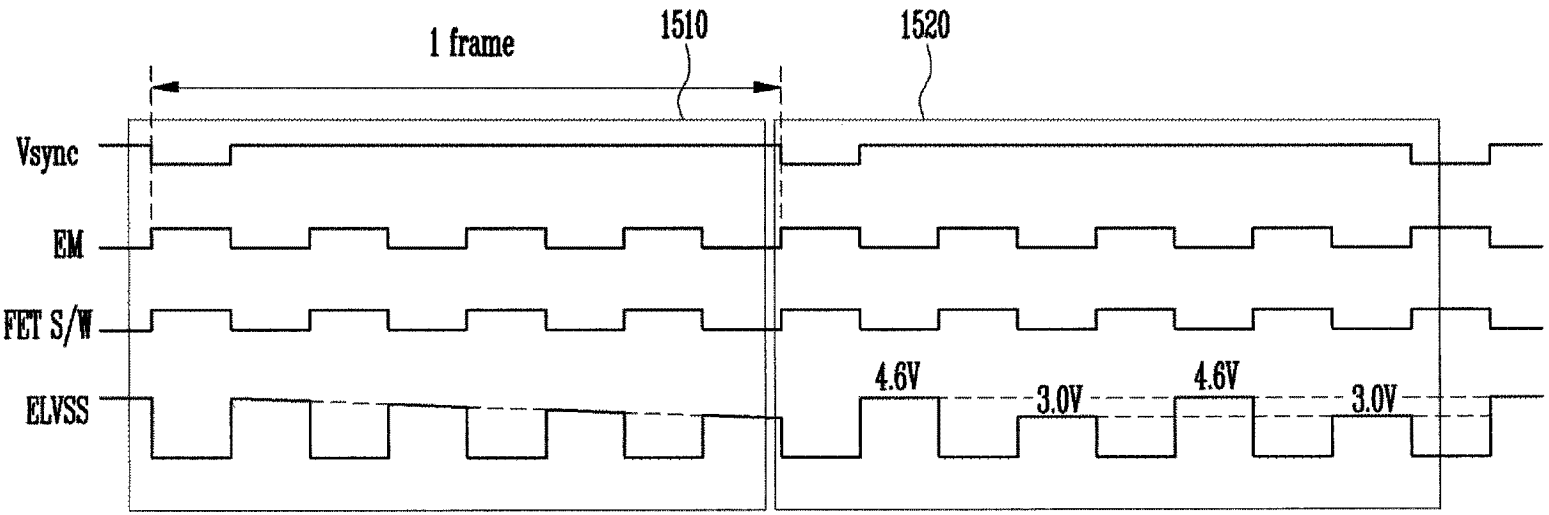
FIG. 15 illustrates a timing chart of the supply of a second power voltage in accordance with another embodiment of the present invention.

FIG. 15 illustrates a supply timing chart of a second power voltage in accordance with another embodiment of the present invention.

Referring to FIG. 15, the second power voltage supply switch FET S/W may be turned on/off cyclically and repeatedly throughout the entire course of one frame. And when the second power voltage supply switch FET S/W is turned on, the second power voltage ELVSS may be supplied to the display unit, and when the second power voltage supply switch FET S/W is turned off, the supply of the second power voltage to the display unit may be blocked. In accordance with an embodiment of the present invention, when high luminance is displayed, the length of each section in which the second power voltage is supplied in one frame may be the same as that of a section in which a vertical synchronization signal Vsync is input.

Here, to reduce or eliminate unwanted effects on pixel circuits due to level changes in power voltage, the level of the first power voltage ELVDD may be changed. For example, the switching level of a power voltage may be when the first power voltage ELVDD is high and the second power voltage ELVSS is low. Here, the power supply unit, as shown in the first frame 1510, may continuously decrease the voltage in effect when the second power voltage ELVSS is not supplied (which will be called the first power voltage ELVDD for ease of illustration) during one frame period. Or the first power voltage ELVDD may be set different for each duty during one frame period, as shown in the second frame 1520. For example, during the first duty, a first power voltage ELVDD may be about 4.6V, and during the second duty, it may be about 3.0V. The first power voltage ELVDD may change for each duty.

Figure 16:
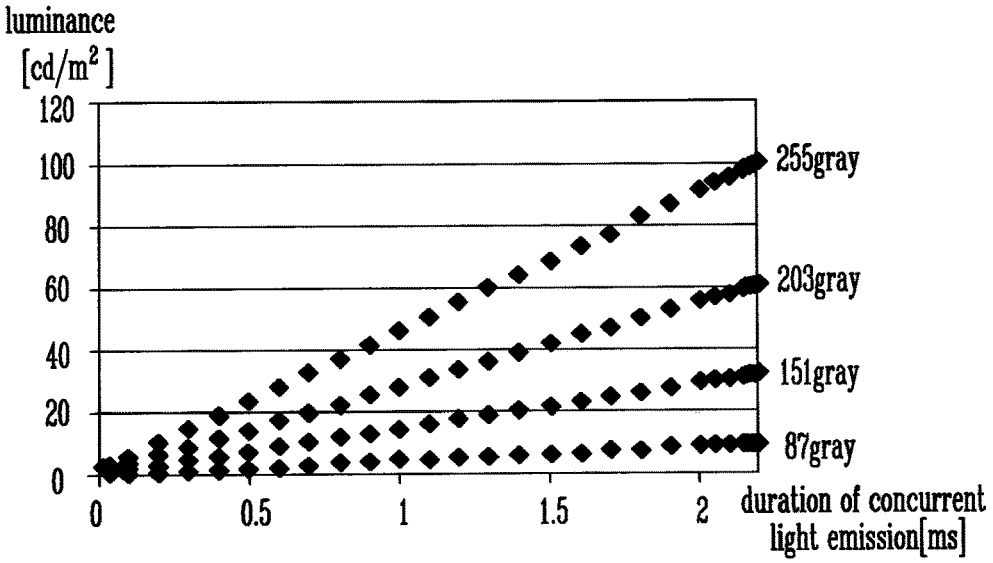
FIG. 16 illustrates an improvement in luminance characteristics per dimming level and the degree of dimming profile freedom in a display device in accordance with an embodiment of the present invention.
Figure 16:
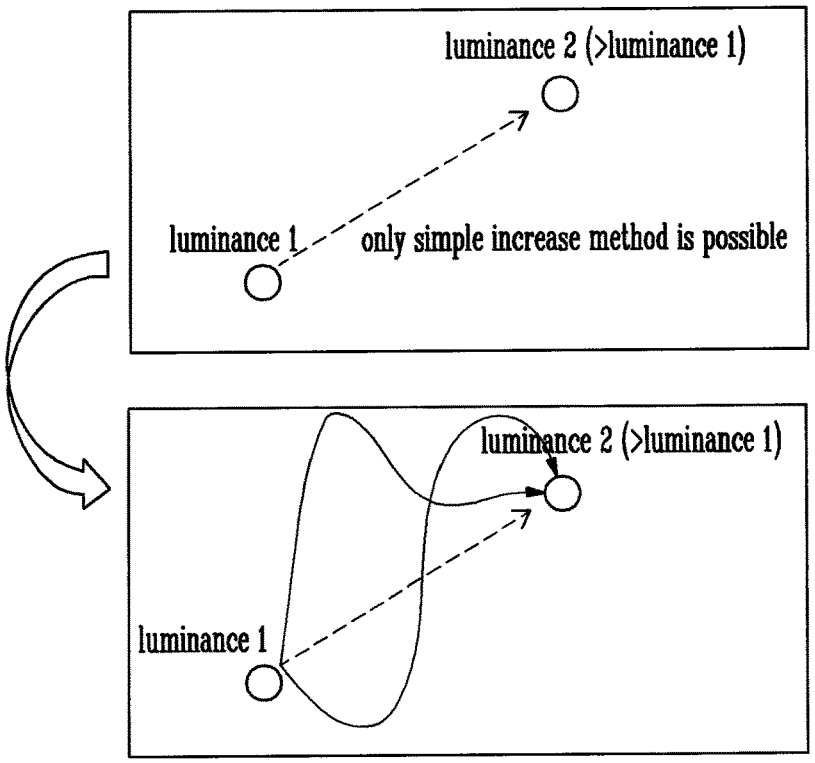

FIG. 16 illustrates an improvement in luminance characteristics per dimming level and the degree of dimming profile freedom in a display device in accordance with an embodiment of the present invention.

Referring to part (a) of FIG. 16, it is shown that light emission time and luminance increase constantly regardless of dimming level. Therefore, in accordance with an embodiment of the present invention, it may be confirmed that there is no luminance inversion due to different dimming levels.

Also, referring to part (b) of FIG. 16, dimming levels may be subdivided. In other words, according to conventional technology, when second luminance is higher than first luminance, only the simple increase method used to be possible when changing from the first luminance to the second luminance. However, in accordance with an embodiment of the present invention, dimming higher than 10-bit dimming may be possible, enabling to draw up diverse dimming profiles, which may increase the degree of freedom.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims and their equivalents.

What is claimed is:

1. A display device, comprising:

a display unit comprising a plurality of pixels;

a first power supply unit configured to supply a first power voltage to the display unit; and a second power supply unit configured to cyclically supply a second power voltage to the display unit during a frame period, wherein the second power supply unit is configured to:

adjust a supply time of the second power voltage during which the second power voltage is supplied to the display unit depending on intended luminance of the display unit;

receive the first power voltage and an alternative second power voltage from the first power supply unit;

generate and output a new second power voltage using the first power voltage and the alternative second power voltage; and cyclically supply the new second power voltage to the display unit during the frame period.

2. The display device as claimed in claim 1, wherein the first power supply unit comprises the second power supply unit.

3. The display device as claimed in claim 1, further comprising a signal controller configured to transmit a control signal to the first power supply unit and to the second power supply unit.

4. The display device as claimed in claim 1, further comprising a second power voltage supply switch coupled between the display unit and the second power supply unit, wherein the second power supply unit is configured to cyclically supply the second power voltage to the display unit depending on operation of the second power voltage supply switch.

5. The display device as claimed in claim 1, wherein the second power supply unit is configured to determine a size of the second power voltage supplied during the frame period depending on the intended luminance of the display unit.

6. The display device as claimed in claim 1, wherein the second power supply unit is configured to supply the second power voltage while changing the second power voltage during the frame period depending on the intended luminance of the display unit.

7. The display device as claimed in claim 1, wherein the second power supply unit is configured to supply the second power voltage while changing timing in which the second power voltage is supplied during the frame period depending on the intended luminance of the display unit.

8. The display device as claimed in claim 1, wherein the first power supply unit is further configured to continuously reduce the first power voltage during the frame period.

9. The display device as claimed in claim 1, wherein the first power supply unit is further configured to change the first power voltage during the frame period, and is further configured to supply the changed first power voltage to the display unit.

10. A method of controlling a display device, the method comprising:

receiving a control signal at a second power supply unit; and cyclically supplying a second power voltage from the second power supply unit to a display unit during a frame period depending on the control signal, wherein the second power supply unit is configured to:

adjust a supply time of the second power voltage during which the second power voltage is supplied to the display unit depending on intended luminance of the display unit;

receive a first power voltage and an alternative second power voltage from a first power supply unit;

generate and output a new second power voltage using the first power voltage and the alternative second power voltage; and cyclically supply the new second power voltage to the display unit during the frame period.

11. The method as claimed in claim 10, wherein the cyclically supplying the second power voltage further comprises using the second power supply unit to determine a size of the second power voltage supplied during the frame period depending on the intended luminance of the display unit.

12. The method as claimed in claim 10, wherein cyclically supplying the second power voltage further comprises supplying the second power voltage while using the second power supply unit to change a size of the second power voltage during the frame period depending on the intended luminance of the display unit.

13. The method as claimed in claim 10, wherein the cyclically supplying the second power voltage further comprises supplying the second power voltage while using the second power supply unit to change timing for which the second power voltage is supplied during the frame period depending on the intended luminance of the display unit.

* * * * *